US005218916A

United States Patent [19]

Kurono et al.

[11] Patent Number: 5,218,916

[45] Date of Patent: Jun. 15, 1993

[54] AUTOMATIC SEWING SYSTEM CAPABLE OF TRANSFERRING STITCH DATA

[75] Inventors: Yoshikazu Kurono, Aichi; Narihiro Matsushita, Kasugai, both of Japan

[73] Assignee: Brother Kogyo Kabushiki Kaisha, Nagoya, Japan

[21] Appl. No.: 849,975

[22] Filed: Mar. 12, 1992

[30] Foreign Application Priority Data

May 8, 1991 [JP] Japan ..... 3-135824

[51] Int. Cl.[5] ..... D05B 21/00; D05B 25/00

[52] U.S. Cl. ..... 112/121.12; 112/155; 112/445

[58] Field of Search ..... 112/121.12, 121.11, 112/103, 102, 155, 445, 453, 454, 456, 458; 364/470

[56] References Cited

U.S. PATENT DOCUMENTS

| | | | |
|---|---|---|---|
| 4,369,722 | 1/1983 | Nishida et al. | 112/103 |
| 4,413,574 | 11/1983 | Hirota et al. | 112/121.12 |
| 4,635,574 | 1/1987 | Fujita et al. | 112/121.12 |
| 4,932,342 | 6/1990 | Hisatake et al. | 112/121.12 X |
| 4,960,061 | 10/1990 | Tajima et al. | 112/445 X |
| 5,001,996 | 3/1991 | Tajima et al. | 112/103 |

FOREIGN PATENT DOCUMENTS 1-45393 3/1989 Japan .

*Primary Examiner*—Peter Nerbun

*Attorney, Agent, or Firm*—Oliff & Berridge

[57] ABSTRACT

An automatic sewing system includes an embroidery machine and a personal computer. The embroidery machine has an operation panel provided with a LCD, a stitch type display key and a stitch type selecting key, and a sewing control device provided with a stitch type data memory and a stitch data memory. The personal computer has a floppy disc drive unit capable of receiving a floppy disc which stores stitch data and stitch type data. The stitch type data are sent to the sewing control device from the personal computer and stored in the stitch type data memory when the stitch type display key is operated. The LCD displays thereon a stitch type based on the stitch type data stored in the stitch type data memory. The stitch data related to the displayed stitch type are sent to the sewing control device from the personal computer and stored in the stitch data memory when the stitch type selecting key is operated. The embroidery machine forms a stitch pattern on a work fabric based on the stitch data stored in the stitch data memory.

20 Claims, 8 Drawing Sheets

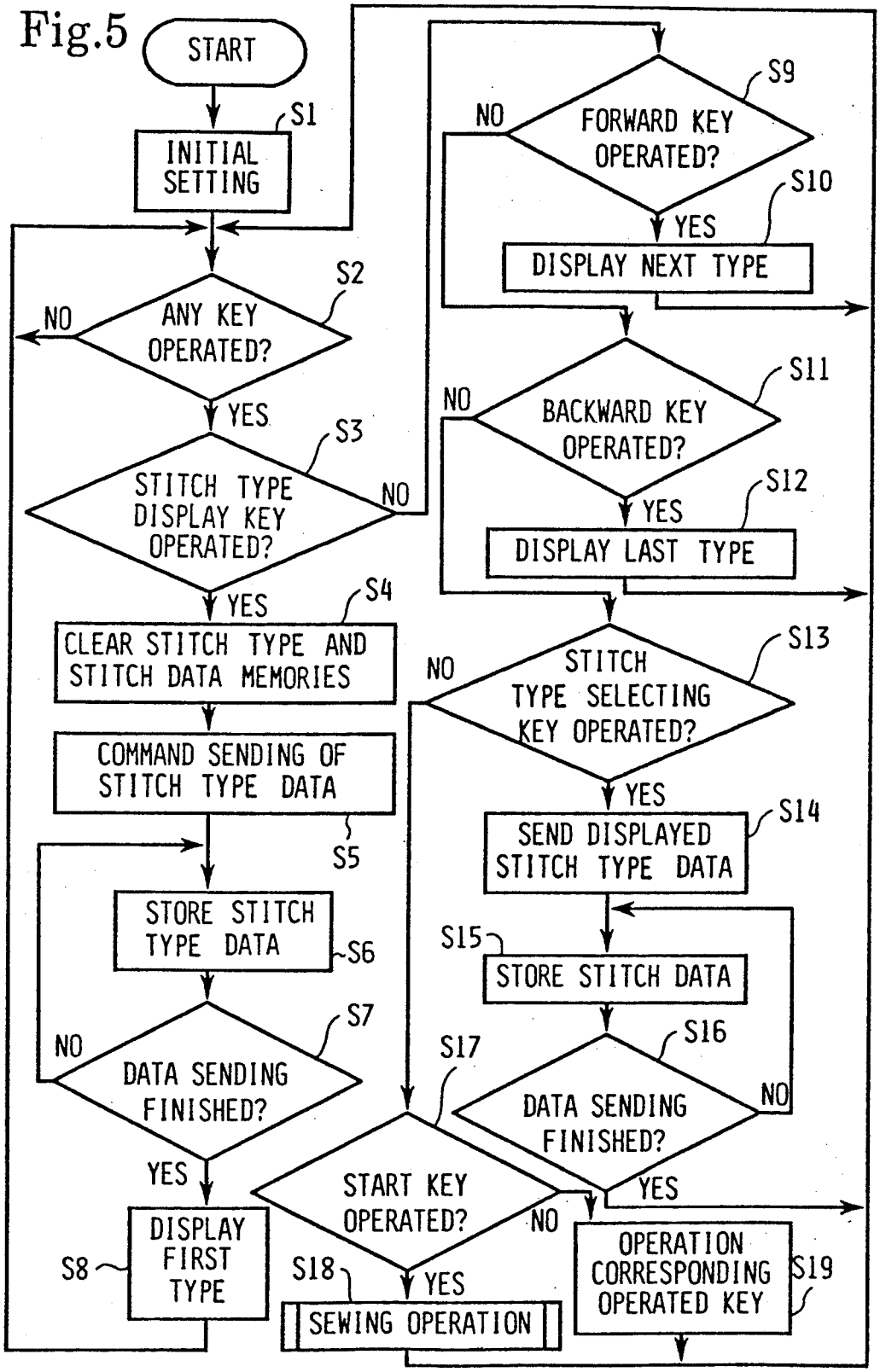
Fig.5
START
S1
INITIAL SETTING
S2
ANY KEY OPERATED?
NO
YES
S3
STITCH TYPE DISPLAY KEY OPERATED?
NO
YES
S4
CLEAR STITCH TYPE AND STITCH DATA MEMORIES
COMMAND SENDING OF STITCH TYPE DATA
S5
STORE STITCH TYPE DATA
S6
S7
DATA SENDING FINISHED?
NO
YES
S8
DISPLAY FIRST TYPE
S9
FORWARD KEY OPERATED?
NO
YES
S10
DISPLAY NEXT TYPE
S11
BACKWARD KEY OPERATED?
NO
YES
S12
DISPLAY LAST TYPE
S13
STITCH TYPE SELECTING KEY OPERATED?
NO
YES
S14
SEND DISPLAYED STITCH TYPE DATA
S15
STORE STITCH DATA
S16
DATA SENDING FINISHED?
NO
YES
S17
START KEY OPERATED?
NO
YES
S18
SEWING OPERATION
OPERATION CORRESPONDING OPERATED KEY
S19

AUTOMATIC SEWING SYSTEM CAPABLE OF TRANSFERRING STITCH DATA

BACKGROUND OF THE INVENTION

1. Field of the Invention

The present invention relates to an automatic sewing system including a computer which is capable of sending stitch data and an automatic sewing machine which is connected with the computer and is capable of instructing the computer to send stitch data thereto.

2. Description of Related Art

Generally, a conventional automatic sewing apparatus includes an automatic sewing machine and a computer which is connected with the automatic sewing machine through an interface. The computer stores stitch data for forming a plurality of stitch patterns. The automatic sewing machine forms various stitch patterns, such as a character or a figure, on a work-fabric based on the stitch data stored in the computer.

An automatic sewing apparatus is disclosed in Japanese Patent Publication No. 1-45393. The automatic sewing apparatus includes an automatic sewing machine and a personal computer connected with the automatic sewing machine through an interface. The automatic sewing machine is provided with an XY-table for holding a work-fabric, a moving device for moving the XY-table in two orthogonal directions, a stitch forming device for forming a stitch on the work-fabric, and a control device for controlling the moving device and the stitch forming device. The personal computer is provided with a keyboard, a CRT-display and a floppy disc drive unit which can receive a floppy disc storing stitch data for forming various stitch patterns.

In the automatic sewing apparatus, when a type of stitch data and a transferring command are input through the keyboard, the personal computer reads out stitch data corresponding to the input stitch type from a floppy disc set in the floppy disc drive unit and transfers the stitch data to the control device of the automatic sewing machine. The control device of the automatic sewing machine stores the transferred stitch data in a memory unit thereof and controls the moving device and the stitch forming device based on the stored stitch data thereby forming a desired stitch pattern on the work-fabric.

The applicants of the present invention have also previously developed an automatic sewing apparatus which includes an automatic sewing machine and a personal computer connected with the automatic sewing machine through an interface. The automatic sewing machine is provided with a moving device for moving a work-fabric in two orthogonal directions, a stitch forming device for forming a stitch on the work-fabric, and a control device for controlling the moving device and the stitch forming device. The automatic sewing machine is further provided with an operation panel connected with the control device. The operation panel has alphabet keys, numeral keys and a commanding key. The personal computer is provided with a keyboard, a CRT-display and a floppy disc drive unit which can receive a floppy disc storing stitch data for forming various stitch patterns.

In the automatic sewing apparatus, when the commanding key on the operation panel of the automatic sewing machine is operated after a type of stitch data is input through the alphabet keys or numeral keys on the operation panel, the control device of the automatic sewing machine transfers a stitch type signal representing the inputted type of stitch data to the personal computer. The personal computer reads out stitch data corresponding to the type represented by the stitch type signal from a floppy disc set in the floppy disc drive unit and transfers the stitch data to the control device of the automatic sewing machine when the personal computer receives the stitch type signal. The control device of the automatic sewing machine stores the transferred stitch data in a memory unit thereof and controls the moving device and the stitch forming device based on the stored stitch data thereby forming a desired stitch pattern on the work-fabric.

It is very troublesome for an operator to operate the automatic sewing apparatus disclosed in Japanese Patent Publication No. 1-45393. In order to form a desired stitch pattern on the work-fabric, the operator selects a type of stitch data and inputs a transferring command at the personal computer side of the apparatus for transferring stitch data corresponding to the selected stitch type to the automatic sewing machine. Then, the operator has to move to the automatic sewing machine side to operate the automatic sewing machine.

On the other hand, it is troublesome for the operator to operate the automatic sewing apparatus previously developed by the applicants of the present invention, too since the operation panel of the automatic sewing machine can not display the types of stitch data stored in the personal computer. Accordingly, before inputting a desired type of stitch data, the operator must make a note of the desired stitch type while watching a plurality of types displayed on the display of the personal computer, or the operator must print out a list of stitch types from the personal computer. Therefore, it is very complicated for the operator to input the type of a desired stitch pattern. In addition, it is possible for the operator to make a mistake while inputting a type.

SUMMARY OF THE INVENTION

An object of the present invention is to provide an automatic sewing system which is capable of being operated easily.

Another object of the present invention is to provide an automatic sewing machine which can easily store stitch data therein from the computer connected with the automatic sewing machine.

An additional object of the present invention is to provide an automatic sewing system wherein desired stitch data is easily selected by the automatic sewing machine from stitch data stored in the computer connected with the automatic sewing machine.

A further object of the present invention is to provide an automatic sewing system including a computer for storing stitch data related to types of stitch data, or names of stitch patterns, and an automatic sewing machine which can display types of stitch data stored in the computer.

To achieve the above-mentioned objects, an automatic sewing system having an automatic sewing machine and a computer according to the present invention includes: stitch forming means provided in the automatic sewing machine for forming a stitch on a workpiece; moving means provided in the automatic sewing machine for relatively moving the stitch forming means and the workpiece in a horizontal plane; stitch data memory means provided in the computer for storing a plurality of stitch data each of which is related with a type of stitch data; stitch type data memory means provided in the computer for storing stitch type data each of which represents a type of stitch data; first instructing means provided in the automatic sewing machine for generating a first instruction so as to instruct the computer to send stitch type data stored in the stitch data memory means; first sending means provided in the computer for sending the stitch type data to the automatic sewing machine in response to the first instruction generated by the first instructing means; stitch type data storing means provided in the automatic sewing machine for storing the stitch type data sent by the first sending means; displaying means provided in the automatic sewing machine for displaying a type of stitch data based on the stitch type data stored in the stitch type data storing means; selecting means provided in the automatic sewing machine for selecting a type of stitch data through a type displayed by the displaying means; second instructing means provided in the automatic sewing machine for generating a second instruction for instructing the computer to send stitch data corresponding to the type selected by the selecting means; second sending means provided in the computer for sending stitch data corresponding to the type selected by the selecting means to the automatic sewing machine in response to the second instruction generated by the second instructing means; stitch data storing means provided in the automatic sewing machine for storing stitch data sent by the second sending means; and sewing control means provided in the automatic sewing machine for controlling the stitch forming means and the moving means based on stitch data stored by the stitch data storing means.

In the automatic sewing system of the present invention, the first sending means of the computer sends stitch type data to the automatic sewing machine when the first instructing means of the automatic sewing machine generates the first instruction. Then, the stitch type data storing means of the automatic sewing machine stores the stitch type data and the displaying means of the automatic sewing machine displays at least one of the stitch types based on the stitch type data.

When a desired stitch type is selected by the selecting means of the automatic sewing machine through a stitch displayed by the displaying means and the second instruction is generated by the second instructing means of the automatic sewing machine, the second sending means of the computer sends stitch data corresponding to the type selected by the selecting means to the automatic sewing machine. Then, the stitch data storing means of the automatic sewing machine stores the stitch data and 30. The sewing control means of the automatic sewing machine controls the stitch forming means and the moving means of the automatic sewing machine based on the stitch data. So that, a desired stitch pattern corresponding to the selected type is formed on a workpiece.

According to the automatic sewing system of the present invention including the automatic sewing machine and the computer, a type of stitch data stored in the computer can be displayed by the displaying means provided in the automatic sewing machine. A desired stitch type can be selected by the selecting means provided in the automatic sewing machine through a type displayed by the displaying means. Therefore, at the automatic sewing machine side, an operator can select a type of stitch data and can input a transferring command for transferring stitch data corresponding to the selected type from the computer to the automatic sewing machine when the operator starts a sewing operation. The operator need not make note of the type of a desired stitch pattern or print out a list of stitch types in advance. Thus, it becomes very easy for the operator to store desired stitch data in the automatic sewing machine. In addition, it becomes easy for the operator to select a type of stitch data because the operator only selects a desired type from the stitch types displayed on the display means. Therefore, the operator is prevented from making a mistake while inputting a stitch type.

BRIEF DESCRIPTION OF THE DRAWINGS

Preferred embodiments of the present invention will be described in detail with reference to the following figures wherein:

FIG. 5 is a flowchart explaining a sewing control routine to be executed in the embroidery machine;

DETAILED DESCRIPTION OF THE PREFERRED EMBODIMENTS

Figure 1:
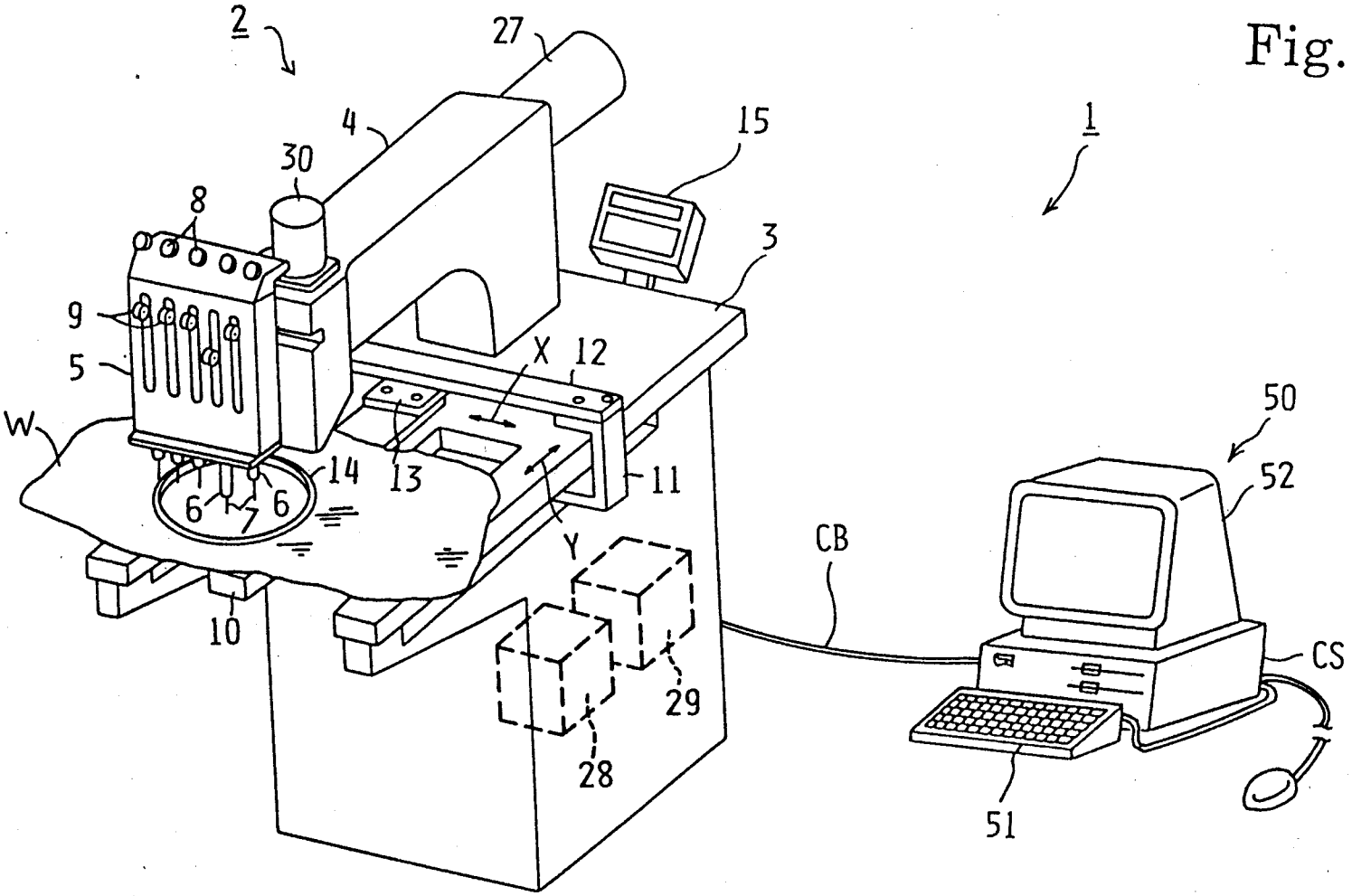
FIG. 1 is a perspective view of an embroidery machine and a personal computer included in an automatic sewing system in accordance with the present invention.

As shown in FIG. 1, an automatic sewing system 1 of the present invention includes an embroidery machine 2 including an automatic sewing machine and a personal computer 50 which functions as a stitch data producing apparatus. An arm 4 of the embroidery machine 2 is mounted on a table 3. A needle bar support case 5 is movably supported on a front end of the arm 4 in a direction shown by an arrow X. Five needle bars 6 are respectively supported by the needle bar support case 5 so that the needle bars 6 are vertically movable. Needles 7 are detachably attached to the lower ends of each of the needle bars 6. Five thread tension regulators 8 and five thread take-ups 9 are provided on the needle bar support case 5. Five needle threads are supplied from five needle sources (not shown). The colors of the five needle threads may be different from each other. Each needle thread supplied from the needle source is led to the needle 7 via the thread tension regulator 8 and thread take-up 9. A needle selecting motor 30 is provided on the arm 4 and is connected with the needle bar support case 5. The needle selecting motor 30 moves the needle bar support case 5, thereby positioning one of the needles 7 at a predetermined operating location.

A sewing motor 27 is provided at a rear end of the arm 4. The drive power of the sewing motor 27 is transmitted through a transmission mechanism provided in the arm 4 to the needle bar 6 positioned at the operating location, thereby moving the needle bar 6 vertically. A bed 10 projects from the table 3 and is opposed to the needle bar 6 positioned at the operating location. The bed 10 includes a known thread loop taker for forming stitches on a work fabric W in cooperation with the needle 7. The needles 7 and the thread loop taker compose a stitch forming means.

A pair of Y-direction moving arms 11 are provided at both sides of the table 3. FIG. 1 shows only the Y-direction moving arm 11 at one side of the table 3. The Y-direction moving arms 11 can reciprocate in a direction shown by arrow Y. The Y-direction moving arms 11 are driven by a Y-direction moving motor 29 which is shown schematically in FIG. 1 and FIG. 3. A support beam 12 is provided between the pair of the Y-direction moving arms 11. An end of an X-direction moving arm 13 is movably supported by the support beam 12 in a direction shown by arrow X which is orthogonal to the direction shown by the arrow Y. The X-direction moving arm 13 is moved by an X-direction moving motor 28 which is shown schematically in FIG. 1 and FIG. 3. An embroidery frame 14 is provided on the X-direction moving arm 13. The work fabric W is detachably held by the embroidery frame 14. Accordingly, the work fabric W held by the embroidery frame 14 is moved in the direction shown by the arrow Y when the Y-direction moving arms 11 are moved by the Y-direction moving motor 29, and also, in the direction shown by the arrow X when the X-direction moving arm 13 is moved by the X-direction moving motor 28. Through this movement, various stitch patterns, such as a character or a figure, are formed on the work fabric W.

The Y-direction moving arms 11, the support beam 12, X-direction moving arm 13, the Y-direction moving motor 29, the X-direction moving motor 28, and the embroidery frame 14 compose a moving means for relatively moving the stitch forming means and the workpiece in a horizontal plane.

Figure 2:
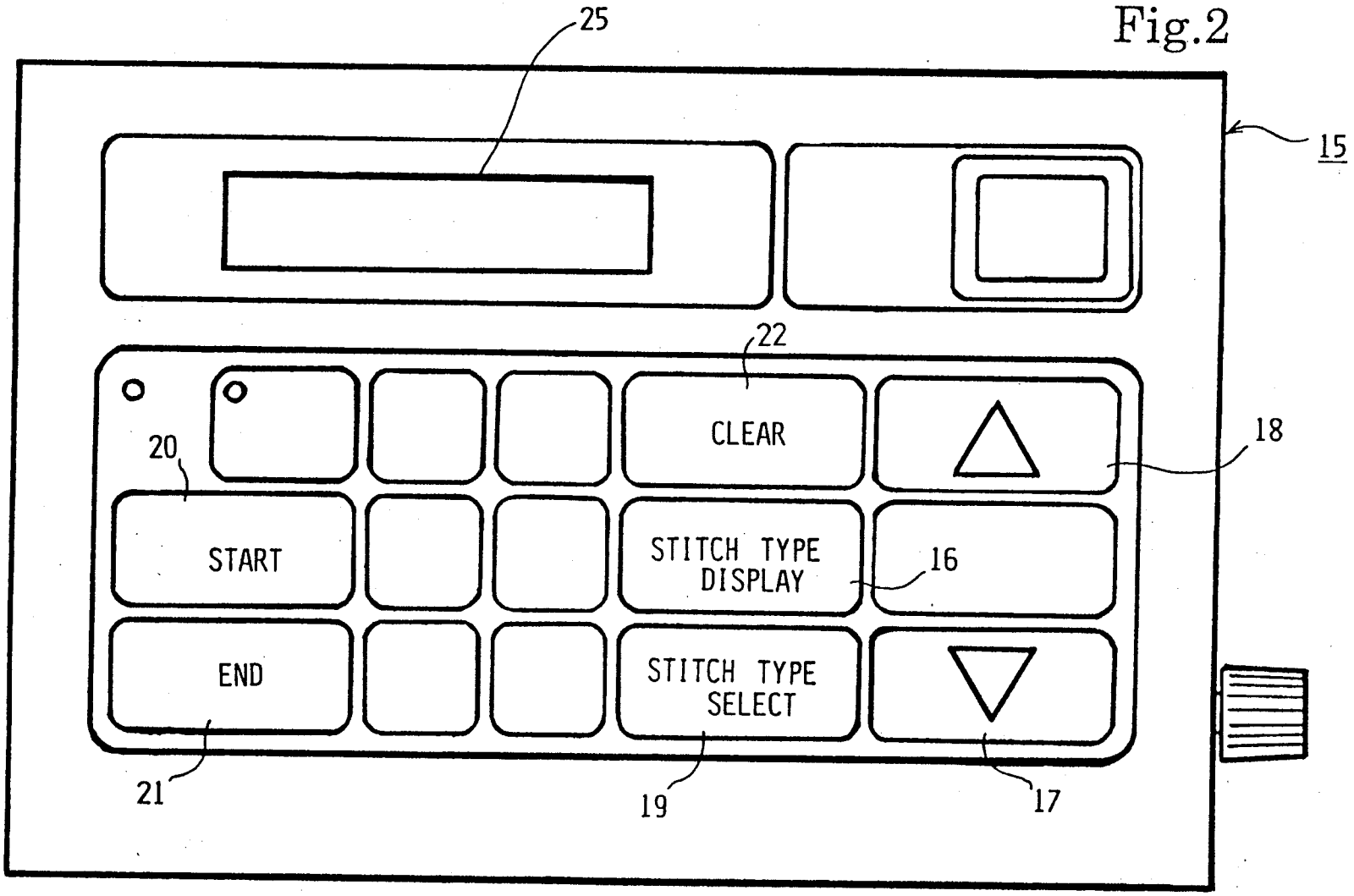
FIG. 2 is a plan view of an operation panel provided on the embroidery machine.

An operation panel 15 is mounted on a rear end of the table 3. As shown in FIG. 2, the operation panel 15 is provided with a liquid crystal display (hereinafter referred to as LCD) 25, a stitch type display key 16, a forward key 17, a backward key 18, a stitch type selecting key 19, a start key 20, an end key 21, and a clear key 22. The LCD 25 displays one type of stitch data which is used for forming a stitch pattern. The LCD 25 displays a type of stitch data when the stitch type display key 16 is operated. One displayed stitch type is changed to the next type of the plurality of stitch types of stitch data in a forward order when the forward key 17 operated, while one displayed type is changed to the next type of the plurality of types of stitch data in a backward order when the backward key 18 is operated. The displayed stitch type is selected when the selecting key 19 is operated. The sewing operation of the embroidery machine 2 is started when the start key 20 is operated and is stopped when the end key 21 is operated.

As shown in FIG. 1, the personal computer 50, or the stitch data producing apparatus, produces stitch data which is utilized to form a stitch pattern such a character or a figure on the work fabric W and to edit the produced stitch data. The personal computer 50 basically includes a CRT display 52, a keyboard 51 and a control box CS. The CRT display 52 displays various data and information such as stitch data, stitch type data representing a type of stitch data, a stitch pattern to be formed on the work fabric W based on the stitch data and type of stitch data represented by the stitch type data. The keyboard 51 includes alphabet keys, numeric keys and a plurality of function keys. The control box CS includes a floppy disc drive unit FM and a control unit C2 as shown in FIG. 4.

Figure 3:
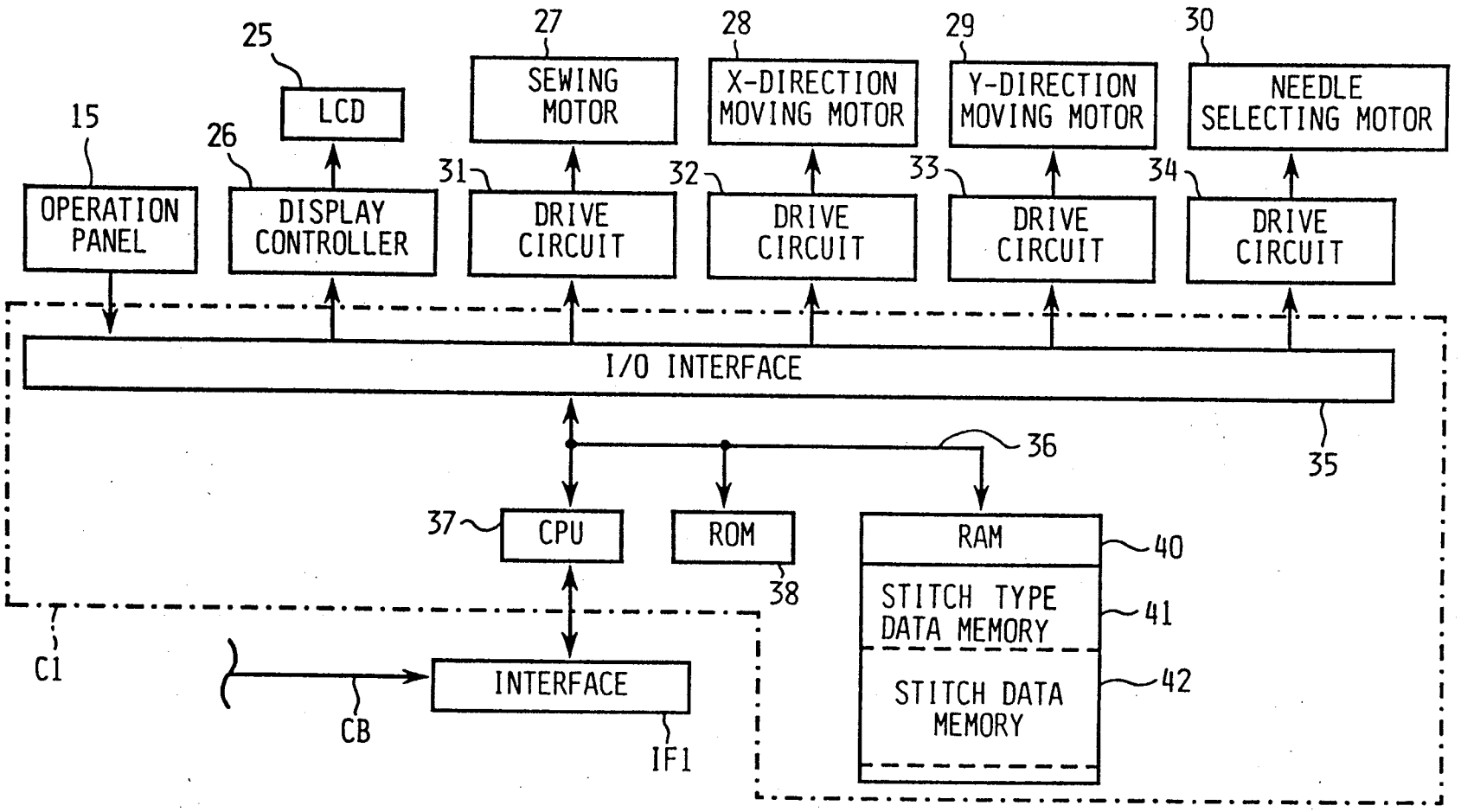
FIG. 3 is a block diagram showing an electrical structure of the embroidery machine.

An electrical structure of the embroidery machine 2 is shown in the block diagram of FIG. 3. The LCD 25 is controlled by a display controller 26 connected thereto. The sewing motor 27 is connected with a drive circuit 31. The X-direction moving motor 28 is connected with a drive circuit 32. The Y-direction moving motor 29 is connected with a drive circuit 33. The needle selecting motor 30 is connected with a drive circuit 34. The motors 27, 28, 29, and 30 are respectively moved by the drive circuits 31, 32, 33, and 34. The operation panel 15, the display controller 26, and the drive circuits 31, 32, 33, and 34 are connected with an I/O interface 35 of a sewing control device C1.

The sewing control device C1 includes a CPU 37, a ROM 38, a RAM 40, the I/O interface 35 and a bus 36 which connects the CPU 37, the ROM 38, the RAM 40 and the I/O interface 35 to each other. The ROM 38 stores therein various programs such as a drive control program for driving the motors 27, 28, 29, and 30, a communication control program for sending data to the control unit C2 of the personal computer 50 and a sewing control program which is described below. The RAM 40 has a stitch type data memory 41, a stitch data memory 42 and various memory utilized to control the embroidery machine 2. The stitch type data memory 41 stores stitch type data, each of which represents a type of stitch data, sent from the personal computer 50, and the stitch data memory 42 stores stitch data sent from the personal computer 50. Further, RAM 40 is provided with a buffer, a pointer and a counter which are utilized to control driving of the embroidery machine 2. An interface IF1 is connected with the CPU 37 and with an interface IF2 of the personal computer 50 through a connecting cable CB.

Figure 4:
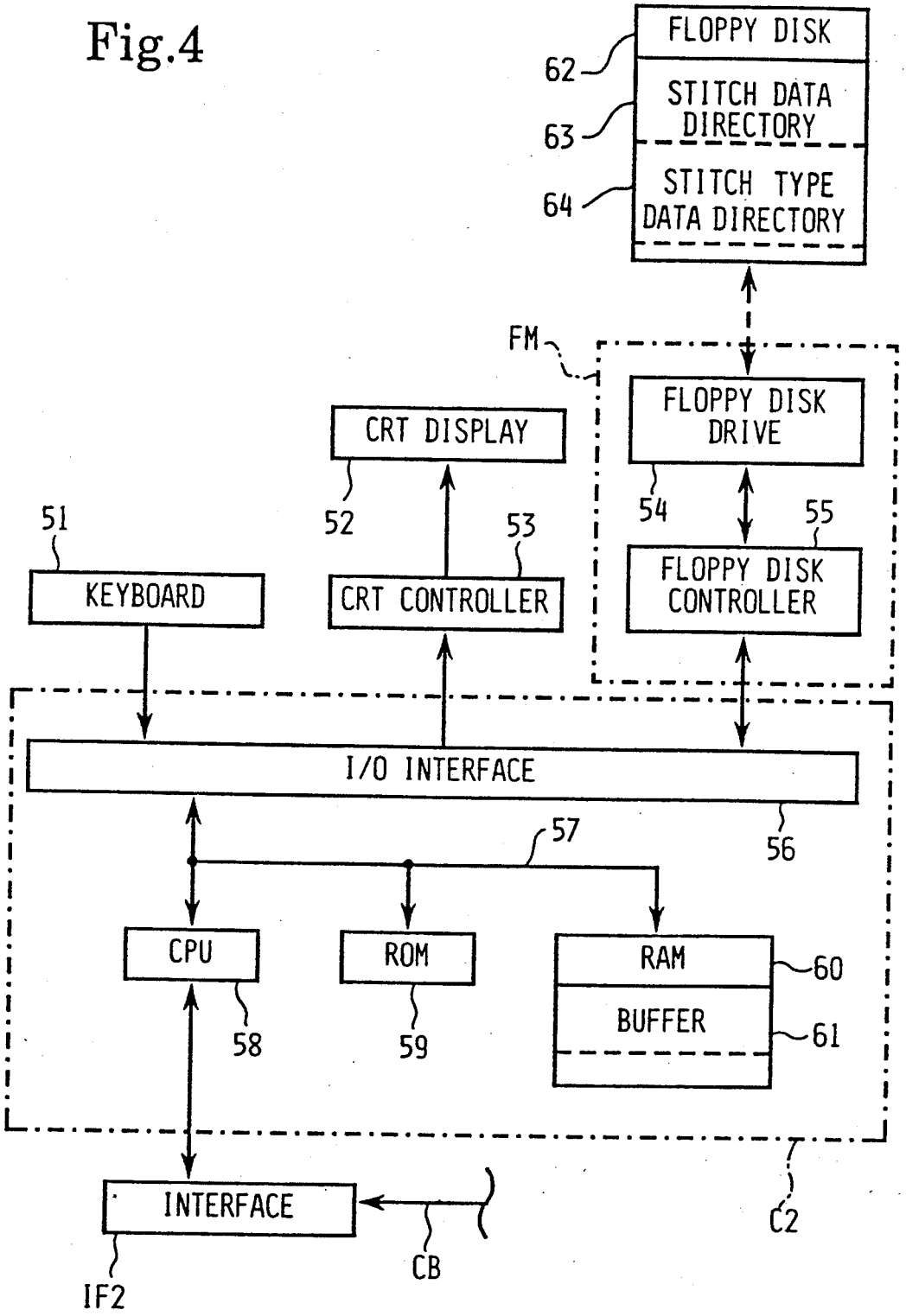
FIG. 4 is a block diagram showing an electrical structure of the personal computer.

An electrical structure of the personal computer 50 is shown in the block diagram of FIG. 4. The CRT display 52 is controlled by a CRT controller 53 connected thereto. The floppy disc drive unit FM includes a floppy disc drive 54 and a floppy disc controller 55 connected with the floppy disc drive 54. The keyboard 51, the CRT controller 53 and the floppy disc controller 55 are connected with an I/O interface 56 of the control unit C2. A floppy disc 62, detachably set in the floppy disc drive 54, stores stitch data in stitch data directories 63 thereof. Further, the floppy disc 62 stores a stitch type data, each of which represents a type of stitch data and is related to the stitch data in a stitch type data directory 64 thereof. Stitch type data relates to the name of the stitch pattern.

The control unit C2 includes a CPU 58, a ROM 59, a RAM 60, the I/O interface 56 and a bus 57 which connects the CPU 58, the ROM 59, the RAM 60 and the I/O interface 56 each other. The ROM 59 stores various programs such as a control program for controlling the personal computer 50, a communication control program for sending data to the sewing control device C1 of the embroidery machine 2, a stitch type data sending program, stitch data sending program, a stitch data producing program and a stitch data editing program. The stitch data stored in the floppy disc 62 are produced by utilizing the stitch data producing program are edited by utilizing the stitch data editing program or are input by utilizing the keyboard 51. The RAM 60 has a buffer 61 for temporarily storing stitch type data and various memory utilized to control the personal computer 50. The interface IF2 is connected with the CPU 58 and with the interface IF1 of the embroidery machine 2 through the connecting cable CB.

Figure 6:
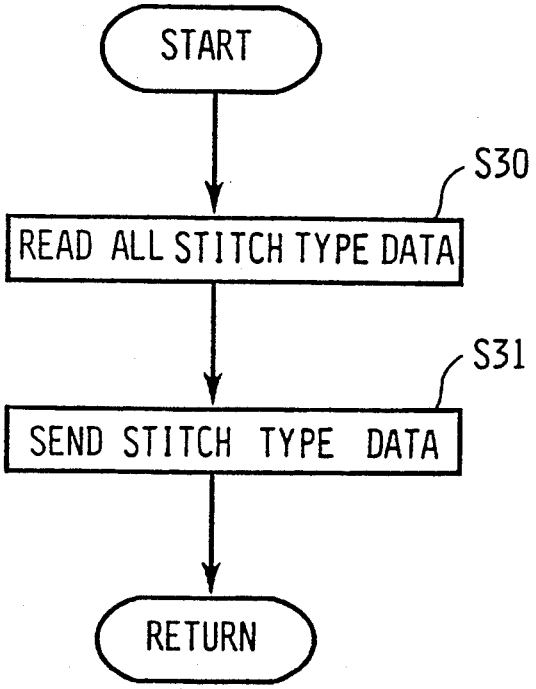
FIG. 6 is a flowchart explaining a stitch type data output control routine to be executed in the personal computer.
Figure 7:
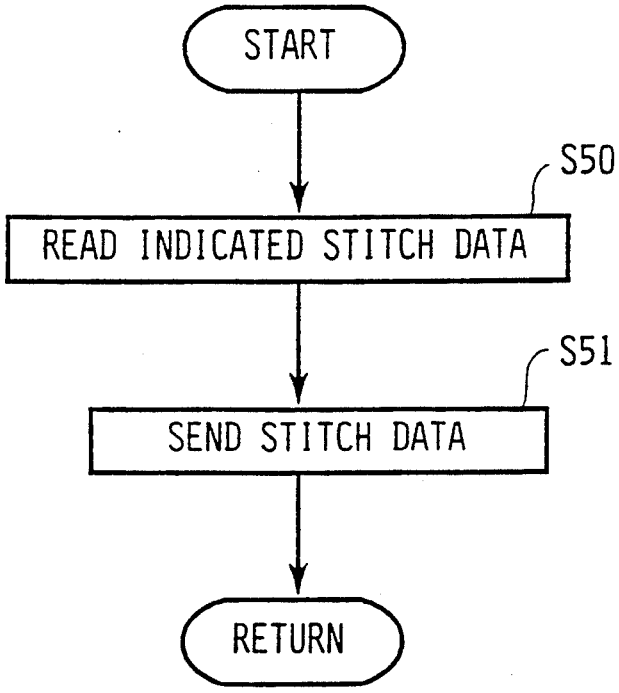
FIG. 7 is a flowchart explaining a stitch data output control routine to be executed in the personal computer.

Next, the operation of the automatic sewing system 1 of the present embodiment will be explained. The flowchart in FIG. 5 shows a sewing control routine to be executed by the sewing control device C1 according to the sewing control program stored in the ROM 38. The flowchart in FIG. 6 shows a stitch type data output control routine to be executed by the control unit C2 according to the stitch type data sending program stored in the ROM 59. The flowchart in FIG. 7 shows a stitch data output control routine to be executed by the control unit C2 according to the stitch data sending program stored in the ROM 59. The reference numeral Si (i=1,2,3 . . . ) in the figures represents the number of each step.

When the power supply for the personal computer 50 is activated, a main routine of the control program stored in the ROM 59 and various subroutines are executed in the control unit C2 of the personal computer 50. On the other hand, when the power supply for the embroidery machine 2 is activated, the sewing control routine shown in the flowchart of FIG. 5 is executed in the sewing control device C1 of the embroidery machine 2. When the sewing control routine is started, initialization is executed (S1), so that the RAM 40 is cleared. When the stitch type display key 16 of the operation panel 15 is operated (S2 & S3: Yes), the stitch type data memory 41 and the stitch data memory 42 in the RAM 40 are cleared, and an instructing signal is output to the control unit C2 of the personal computer 50 (S5). According to the instructing signal, a stitch type data is transmitted. The instructing signal is supplied to the CPU 58 of the control unit C2 through the interface IF1, the connecting cable CB and the interface IF2, and the CPU is given an interrupt request. When the CPU accepts the interrupt request, the stitch type data output control routine shown by the flowchart in FIG. 6 is executed.

When the stitch type data output control routine is started, the stitch type data stored in the stitch type data directory 64 of the floppy disk 62 are read out and are stored temporarily in the buffer 61 of the RAM (S30). The stitch type data stored in the buffer 61 are divided into a predetermined byte prescribed by the protocol, for example, 1K byte, and are transmitted to the sewing control device C1 by each predetermined byte through the interface IF2, the connecting cable CB and the interface IF1 (S31).

The stitch type data in each predetermined byte transmitted to the sewing control device C1 is stored in sequence into the stitch type data memory 41 of the RAM 40 (S6). If the transmission of the stitch type data is not completed (S7: No), the operations in S6 and S7 are repeated. Completion of the transmission of the stitch type data is determined based on the byte amount of the transmitted stitch type data. That is, when the transmitted stitch type data is equal to the predetermined byte, it is determined that the transmission of the stitch type data is not completed. When the transmitted stitch type data is less than the predetermined byte, it is determined that the transmission of the stitch type data is completed. When the transmission of the stitch type data is completed (S7: Yes), a first type data of stitch type data stored in the stitch type data memory 41 is read out and the type represented by the stitch type data is displayed on the LCD 25 (S8) and the process returns to S2.

Next, the forward key 17 of the operation panel 15 is operated (S2: Yes, S3: No, S9: Yes), and the stitch type represented by the stitch type data stored in the stitch type data memory 41 following the stitch type data representing the type being displayed on the LCD 25 is displayed on the LCD 25 (S10). On the other hand, the backward key 18 is operated (S2: Yes, S3 & S9: No, S11: Yes), and the stitch type represented by the stitch type data stored in front of the stitch type data representing the type being displayed on the LCD 25 in the stitch type data memory 41 is displayed on the LCD 25 (S12).

When the stitch type selecting key 19 is operated while the LCD 25 displays a desired stitch type (S2: Yes, S3 & S9 & S11: No, S13: Yes), the stitch type data representing the type being displayed on the LCD 25 is output to the control unit C2 of the personal computer 50 (S14). The selected stitch type data is supplied to the CPU 58 of the control unit C2 through the interface IF1, the connecting cable CB and the interface IF2, so that the CPU 58 is given an interrupt request. When the CPU 58 accepts the interrupt request, the stitch data output control routine shown by the flowchart in FIG. 7 is executed.

When the stitch data output control routine is executed, the stitch data corresponding to the transmitted stitch type data from the stitch data stored in the stitch data directories 63 of the floppy disk 62 is read out and stored temporarily in the buffer 61 of the RAM 60 (S50). The stitch data stored in the buffer 61 is divided into a predetermined byte prescribed by the protocol, for example, 1K byte, and is transmitted to the sewing control device C1 by each predetermined byte through the interface IF2, the connecting cable CB and the interface IF1 (S51).

The stitch data in the each predetermined byte transmitted to the sewing control device C1 is stored in sequence into the stitch data memory 42 of the RAM 42 (S15). If the transmission of the stitch data is not completed (S16: No), the processes in S15 and S16 are repeated. It is determined whether the transmission of the stitch data is completed based on the byte amount of the stitch data transmitted to the sewing control device C1. When the transmitted stitch data is equal to the predetermined byte, it is determined that the transmission of the stitch data is not completed. When the transmitted stitch data is less than the predetermined byte, it is determined that the transmission of the stitch data is completed. When the transmission of the stitch data is completed (S16: Yes), the process returns to S2.

When the start key 20 of the operation panel 15 is operated (S2: Yes, S3 & S9 & S11 & S13: No, S17: Yes), the sewing motor 27, the X-direction moving motor 28, the Y-direction moving motor 29 and the needle selecting motor 30 are respectively driven through the drive circuits 31, 32, 33 and 34 based on the stitch data stored in the stitch data memory 42, so that the stitch processing is executed (S18). The stitch pattern corresponding to the selected stitch type is thus formed on a work fabric W. When a key except the above-mentioned keys 16–20 is operated (S2: Yes,S3 & S9 & S11 & S13 & S17: No), the processing corresponding to the operated key is executed (S19).

As described above according to the automatic sewing system of the present embodiment, the operation panel 15 having the LCD 25, the stitch type display key 16, the forward key 17, the backward key 18 and the stitch type selecting key 19 is mounted on the embroidery machine 2, and therefore one stitch type out of a plurality of types can be displayed on the LCD 25 in sequence. Moreover, since the stitch data corresponding to the desired stitch type selected through the type displayed on the LCD 25 is stored in the stitch data memory 42, the stitch pattern can be formed on a work fabric W based on the stored stitch data. Accordingly, an operator can select a desired stitch type and can input the transferring command to the personal computer 50 at the embroidery machine 2 side. Therefore, the operator need not make note of the desired stitch type, or print out a list of types in advance. Therefore, it becomes very easy for the operator to store desired stitch data in the stitch data memory 42 of the embroidery machine 2 and to start the sewing operation. In addition, the operator can accurately transmit the desired stitch type to the personal computer 50 because the operator only selects the desired type displayed on the LCD 25 by operating the stitch type selecting key 19.

Figure 8:
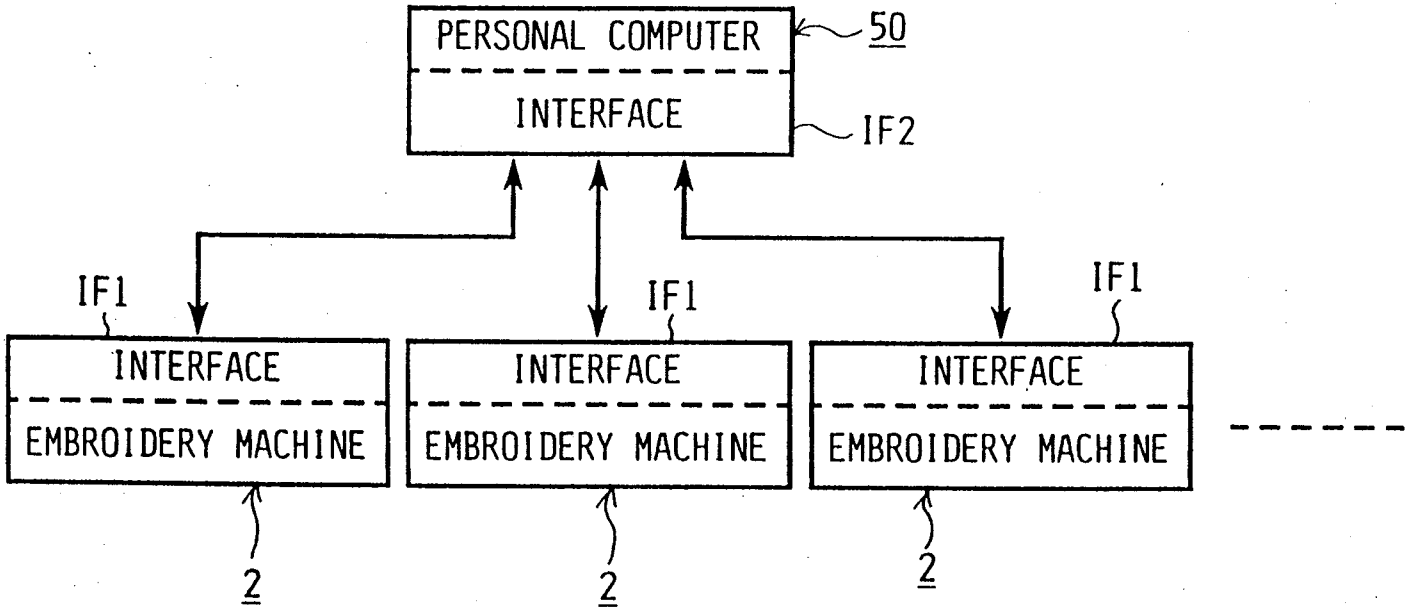
FIG. 8 is a block diagram showing an automatic sewing system including one personal computer and a plurality of embroidery machines connected with the personal computer.

Moreover, the stitch type data sending program is stored in the ROM 59 of the personal computer 50, the operation panel 15 is provided on the embroidery machine 2 and the stitch type data memory 41 is provided in the RAM 40 of the sewing control device C1. Thus, the embroidery machine 2 can be used as a terminal unit for the personal computer 50. Therefore, if a plurality of embroidery machines 2 are connected with one personal computer 50, as shown in FIG. 8, an automatic sewing system can be made compact in size and the cost can be reduced. Further, stitch data stored in the floppy disk 62 in the floppy disk drive 54 of the personal computer 50 can be well utilized as a data base.

The present invention is not limited to the above-mentioned embodiment. It should be understood that many changes and modifications may be made in the embodiment without departing from the scope of the present invention. For instance, a hard disk or a ROM card may be used in place of the floppy disk 62 as memory medium for storing the stitch data.

In addition, an LCD 25 which is large in size in order to display a plurality of stitch types at one time may be used, wherein a desired stitch type is indicated by a cursor which is moved by operation of a cursor moving key.

Further, a large-size host computer may be used in place of the personal computer 50.

Also, a telephone line, a special line or a wireless in place of the connecting cable CB may be used in order to connect the embroidery machine 2 with the personal computer 50.

In addition, a general computer sewing machine which is controlled based on stitch data may be used in place of the embroidery machine 2 as the automatic sewing machine.

What is claimed is:

1. An automatic sewing system comprising:

an automatic sewing machine having stitch forming means for forming a stitch on a workpiece and moving means for relatively moving said stitch forming means and the workpiece in a horizontal plane;

a computer having stitch data memory means for storing stitch data corresponding to types of stitch data and stitch type data memory means for storing stitch type data representing types of stitch data;

first instructing means provided in said automatic sewing machine for generating a first instruction for instructing said computer to send stitch type data stored in said stitch data memory means to said automatic sewing machine;

first sending means provided in said computer for sending the stitch type data to said automatic sewing machine in response to the first instruction generated by said first instructing means;

stitch type data storing means provided in said automatic sewing machine for storing the stitch type data sent by said first sending means;

displaying means provided in said automatic sewing machine for displaying a type of stitch data based on the stitch type data stored in said stitch type data storing means;

selecting means provided in said automatic sewing machine for selecting a type of stitch data through a type displayed by said displaying means;

second instructing means provided in said automatic sewing machine for generating a second instruction for instructing said computer to send stitch data corresponding to the stitch type selected by said selecting means to said automatic sewing machine;

second sending means provided in said computer for sending stitch data corresponding to the stitch type selected by said selecting means to said automatic sewing machine in response to the second instruction generated by said second instructing means;

stitch data storing means provided in said automatic sewing machine for storing stitch data sent by said second sending means; and sewing control means provided in said automatic sewing machine for controlling said stitch forming means and said moving means based on stitch data stored by said stitch data storing means.

2. The automatic sewing system according to claim 1, further comprising:

connecting means for connecting said automatic sewing machine and said computer and for enabling communication between said automatic sewing machine and said computer.

3. The automatic sewing system according to claim 2, further comprising:

an operation panel provided on said automatic sewing machine and including a display, a stitch type display key and a stitch type selecting key, wherein said displaying means includes said display, said first instructing means includes said stitch type display key and said second instructing means includes said stitch type selecting key.

4. The automatic sewing system according to claim 3, wherein said displaying means displays one stitch type of a plurality of stitch types represented by the stitch type data on said display of said operation panel.

5. The automatic sewing system according to claim 4, wherein said operation panel further includes a stitch type changing key for instructing said displaying means to change a stitch type displayed on said display into another stitch type, and wherein said selecting means includes said stitch type changing key.

6. The automatic sewing system according to claim 1, further comprising a plurality of automatic sewing machines coupled to said computer.

7. An automatic sewing system including an automatic sewing machine and a computer, said automatic sewing machine and said computer being in communication, said system comprising:

stitch data memory means in said computer for storing stitch data corresponding to types of stitches;

stitch type data memory means in said computer for storing stitch type data corresponding to types of stitches;

first sending means in said computer for sending the stitch type data to said automatic sewing machine;

second sending means in said computer for sending stitch data to said automatic sewing machine;

first instructing means in said automatic sewing machine for generating a first instruction to said computer to send the stitch data stored in the stitch data memory means to said automatic sewing machine, said first sending means being responsive to said first instruction;

stitch type storing means in said automatic sewing machine for storing stitch type data sent by said first sending means;

displaying means in said automatic sewing machine for displaying the types of stitch data stored in the stitch type data storing means;

selecting means in said automatic sewing machine for selecting a type of stitch data displayed by the displaying means;

second instructing means in said automatic sewing machine for generating a second instruction to said computer to send stitch data corresponding to the stitch type selected by the selecting means to said automatic sewing machine, said second sending means being responsive to said second instruction; and stitch data storing means in said automatic sewing machine for storing stitch data sent by said second sending means.

8. The automatic sewing system as in claim 7, further comprising stitch forming means in said automatic sewing machine for forming a stitch on a workpiece and moving means in said automatic sewing machine for moving said stitch forming means and the workpiece relative to each other.

9. The automatic sewing system as in claim 8, wherein said stitch forming means and said moving means form stitches based on the stitch data corresponding to the selected stitch type.

10. An automatic sewing system including an automatic sewing machine coupled to a computer, said automatic sewing machine comprising:

transferring means provided in said automatic sewing machine for generating an instruction for instructing said computer to transfer data from said computer to said automatic sewing machine;

storing means in said automatic sewing machine for storing the transferred data as stored data;

displaying means for selectively displaying said stored data;

selecting means for selecting data from said stored data; and sewing means for forming stitches based on the selected data.

11. The automatic sewing system as in claim 10, wherein said first transferring means includes means for transferring stitch type data and stitch data corresponding to at least one transferred stitch type.

12. The automatic sewing system as in claim 10, wherein said storing means includes means for storing stitch type data and stitch data for each stitch type.

13. The automatic sewing system as in claim 12, wherein said displaying means displays stitch type data.

14. The automatic sewing system as in claim 12, wherein said selecting means selects stitch type data.

15. The automatic sewing system as in claim 14, wherein said sewing means forms stitches based on the stored stitch data corresponding to the selected stitch type data.

16. The automatic sewing system as in claim 10, wherein said selecting means includes stitch type selecting keys.

17. The automatic sewing system as in claim 10, wherein said displaying means includes stitch type display keys having indicia thereon.

18. The automatic sewing system as in claim 10, said computer comprising:

memory means for storing stitch type data and for storing stitch data corresponding to the stored stitch type data.

19. The automatic sewing system as in claim 18, further comprising second transferring means for transferring stored stitch type data and selectively transferring stored stitch data to said storing means in said automatic sewing machine, wherein said first transferring means instructs said second transferring means to transfer data.

20. The automatic sewing system as in claim 10, further comprising a plurality of automatic sewing machines coupled to said computer.

* * * * *